US008770071B2

(12) United States Patent
Chang et al.

(10) Patent No.: US 8,770,071 B2
(45) Date of Patent: Jul. 8, 2014

(54) ELECTRONIC TORQUE WRENCH WITH A ROTATABLE DISPLAY UNIT

(75) Inventors: Yeh-Ching Chang, Taichung (TW); Hsien-Cheng Lin, Taichung (TW)

(73) Assignee: Yeh-Ching Chang, Taichung (TW)

( * ) Notice: Subject to any disclaimer, the term of this patent is extended or adjusted under 35 U.S.C. 154(b) by 522 days.

(21) Appl. No.: 13/083,397

(22) Filed: Apr. 8, 2011

(65) Prior Publication Data

US 2012/0255405 A1 Oct. 11, 2012

(51) Int. Cl.
*B25B 23/151* (2006.01)
*B25B 23/14* (2006.01)
*B25B 13/16* (2006.01)

(52) U.S. Cl.
USPC ..... 81/467; 81/469; 81/173

(58) Field of Classification Search
USPC ..... 81/467, 479, 173
See application file for complete search history.

(56) References Cited

U.S. PATENT DOCUMENTS 5,142,953 A 9/1992 Lin
6,698,298 B2 * 3/2004 Tsuji et al. ..... 73/862.21
6,968,759 B2 * 11/2005 Becker et al. ..... 81/479
6,981,436 B2 * 1/2006 Becker et al. ..... 81/479
7,082,865 B2 * 8/2006 Reynertson, Jr. ..... 81/479
7,089,834 B2 * 8/2006 Reynertson et al. ..... 81/479
7,331,246 B2 * 2/2008 Escoe et al. ..... 73/862.21
7,469,602 B2 * 12/2008 Gharib et al. ..... 73/862.21
7,562,589 B2 * 7/2009 Anjanappa et al. ..... 73/862.23
7,661,341 B2 * 2/2010 Hsu ..... 81/478
2005/0072278 A1 * 4/2005 Cutler et al. ..... 81/467
2005/0223856 A1 * 10/2005 Reynertson et al. ..... 81/467
2007/0039427 A1 2/2007 Hsieh
2007/0051186 A1 3/2007 Gharib et al.
2008/0168871 A1 * 7/2008 Gharib et al. ..... 81/479

OTHER PUBLICATIONS

U.S. Appl. No. 13/083,242, Office Action mailed Oct. 22, 2013.

* cited by examiner

*Primary Examiner* — David B Thomas
*Assistant Examiner* — Danny Hong
(74) *Attorney, Agent, or Firm* — Foley & Lardner LLP; Andrew S. Baluch

(57) ABSTRACT

An electronic torque wrench a wrench head unit adapted to engage and turn a fastener, a tubular first wrench body securely engaged with the wrench head unit, a tubular second wrench body coupled and aligned with the first wrench body by a fitting member to permit rotation of the second wrench body relative to the first wrench body, a mounting shell sleeved on the second wrench body for mounting a display unit to provide a display representing a measured torque. By rotation of the second wrench body, the display unit can be adjusted to a desired angular position for being viewed easily by the user.

9 Claims, 9 Drawing Sheets

ELECTRONIC TORQUE WRENCH WITH A ROTATABLE DISPLAY UNIT

BACKGROUND OF THE INVENTION

1. Field of the Invention

This invention relates to an electronic torque wrench, more particularly to an electronic torque wrench with a rotatable display unit to be easily viewed by a user.

2. Description of the Related Art

A conventional electronic torque wrench generally includes a head for engaging and turning a fastener, a handle extending from the head to be held by a user for operating the head, and a display coupled to a strain gauge assembly disposed in the handle for displaying the information of torque detected by the strain gauge assembly. In operation, the user grips and turns the handle, and observes the display to read numerical data of the measured torque of the wrench until the fastener is fastened with a desired torque.

However, since the display is affixed to the handle, and is turned therewith during operation, the display may not be kept in a position to be in full view of the user, particularly when the torque wrench is used to operate fasteners at different positions, thereby rendering operation inconvenient.

SUMMARY OF THE INVENTION

An object of the present invention is to provide an electronic torque wrench which has a rotary display unit rotatable by means of a grip handle so as to be easily viewed by the user during operation.

According to this invention, the electronic torque wrench includes a wrench head adapted to engage and turn a fastener, a joint segment extending radially from the wrench head for mounting a strain gauge thereon, a tubular first wrench body which extends along a lengthwise axis and which includes a front tubular end fittingly engaged and secured with the joint segment, and a rear tubular end opposite to the front tubular end, a tubular second wrench body which is disposed rearwardly of and which is aligned with the rear tubular end along the lengthwise axis, and which includes front and rear tubular portions opposite to each other, a fitting member disposed to couple the rear tubular end with the front tubular portion to permit rotation of the second wrench body relative to the rear tubular end about the lengthwise axis, and to permit the first wrench body to transmit a torque applied on the rear tubular portion to the wrench head, amounting shell sleeved on the front tubular portion, and a display unit disposed on the mounting shell to provide a display representing a torque measured by the strain gauge. By rotating the second wrench body about the lengthwise axis, the display unit can be adjusted to a desired angular position to be viewed by the user.

BRIEF DESCRIPTION OF THE DRAWINGS

Other features and advantages of the present invention will become apparent in the following detailed description of the preferred embodiments of the invention, with reference to the accompanying drawings, in which.

DETAILED DESCRIPTION OF THE PREFERRED EMBODIMENT

Figure 1:
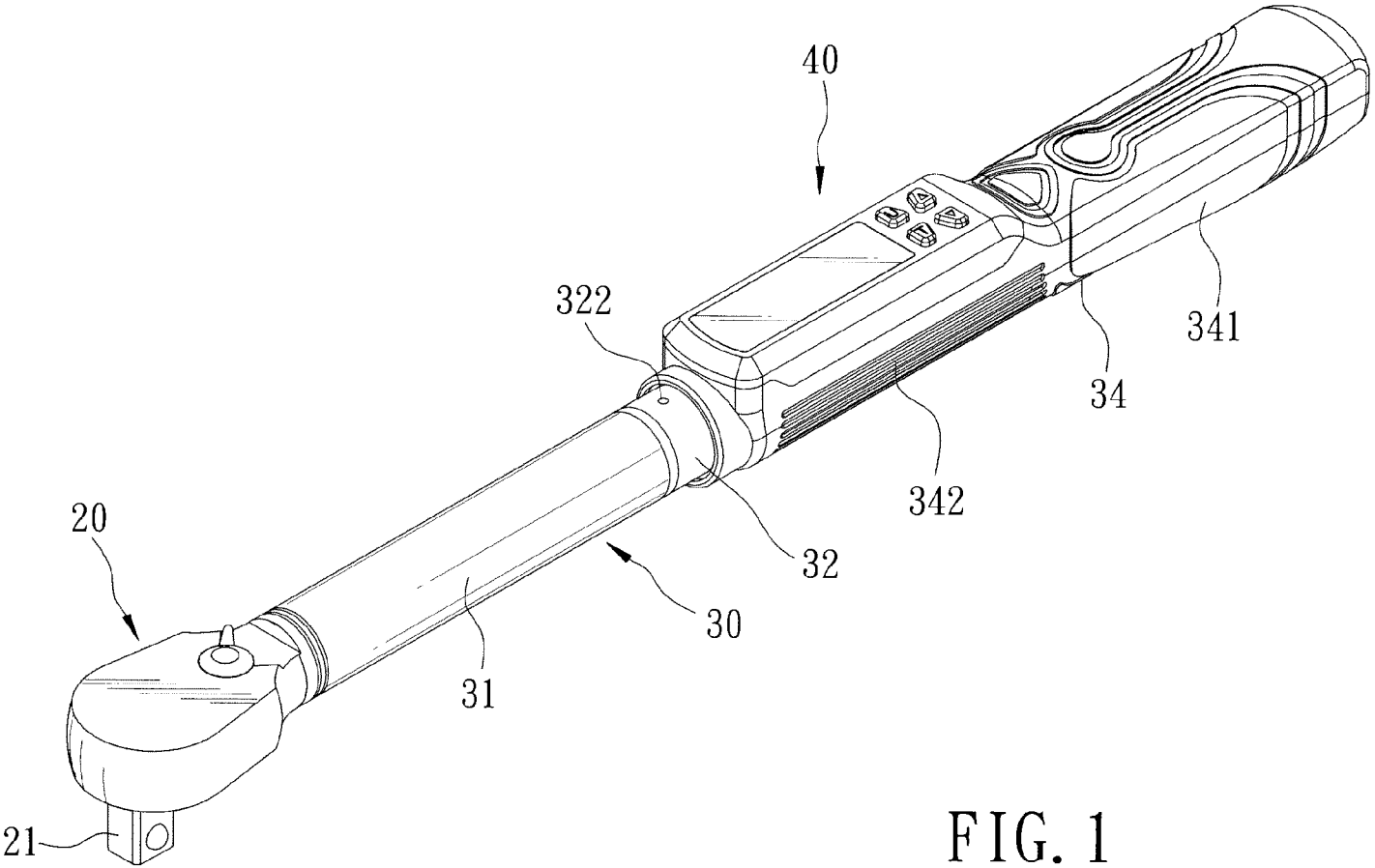
FIG. 1 is a perspective view of the first preferred embodiment of an electronic torque wrench according to this invention.

Referring to FIG. 1, the first preferred embodiment of an electronic torque wrench according to the present invention is shown to comprise a head unit 20, a body unit 30, and a display unit 40.

Figure 2:
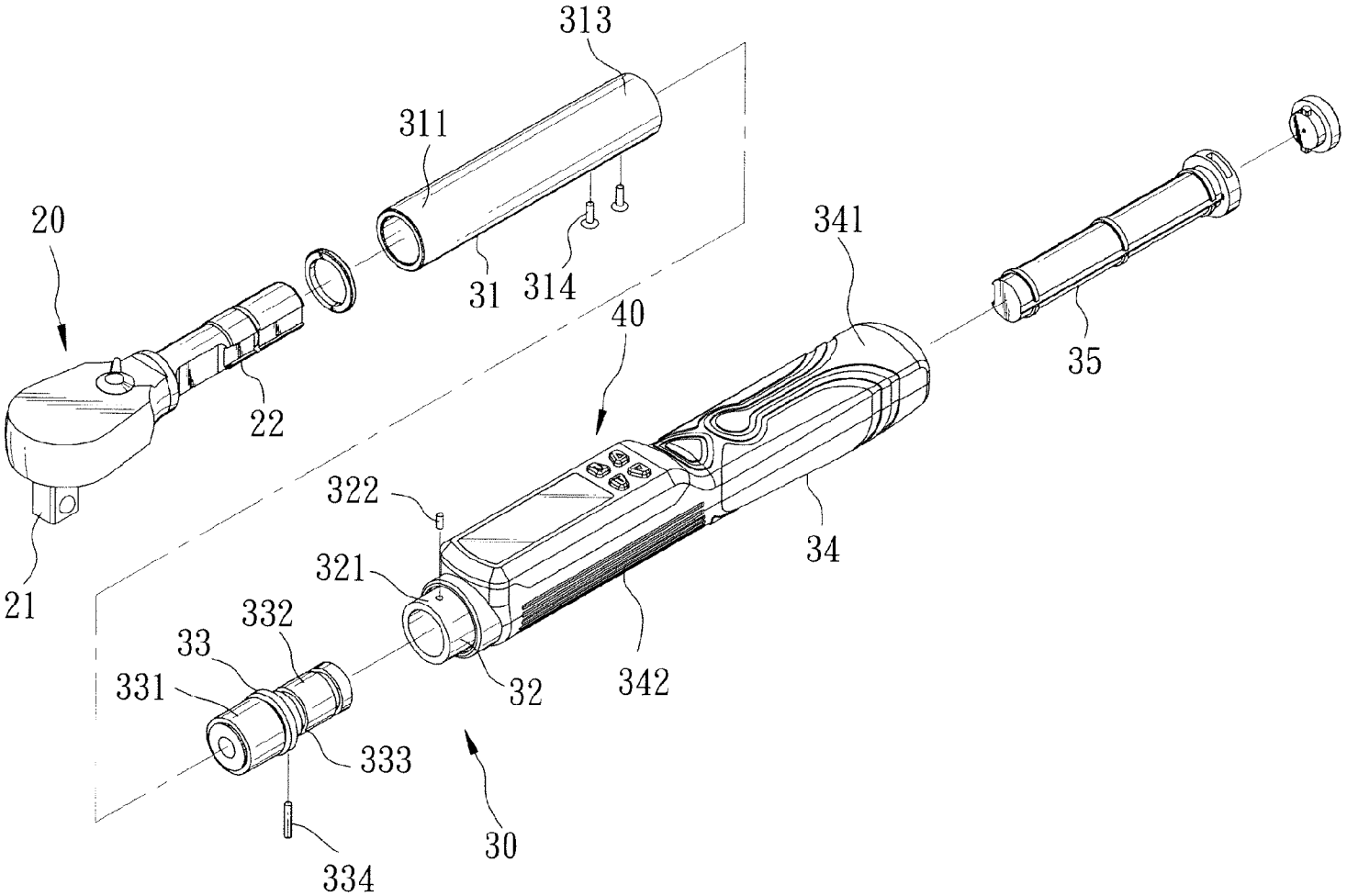
FIG. 2 is an exploded perspective view of the first preferred embodiment.
Figure 3:
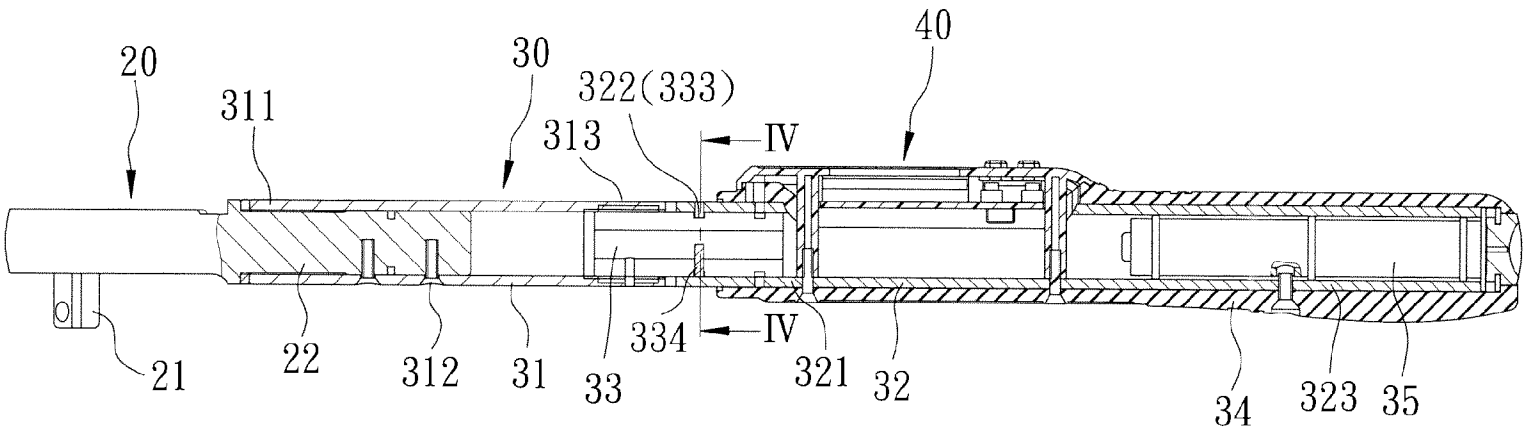
FIG. 3 is a sectional view of the first preferred embodiment.
Figure 4:
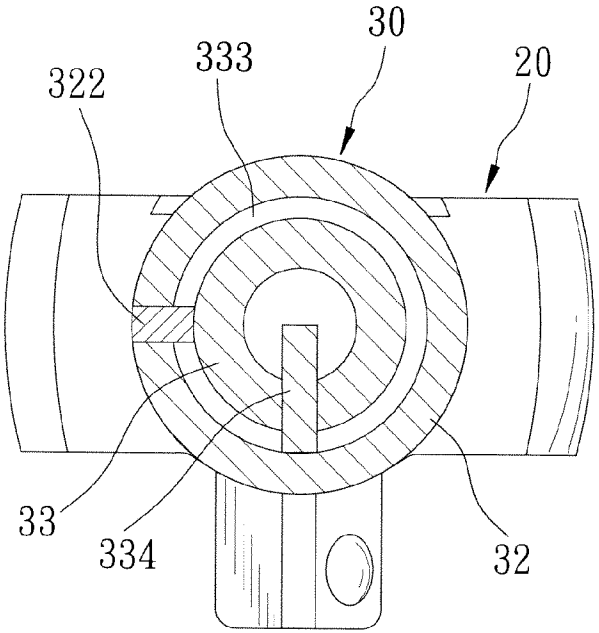
FIG. 4 is a cross-sectional view of the first preferred embodiment taken along line IV-IV of FIG. 3.

Referring to FIGS. 2 to 4, the head unit 20 includes a wrench head 21 adapted to engage and turn a fastener about a torque axis, and a joint segment 22 extending radially from the wrench head 21 relative to the torque axis for mounting a strain gauge (not shown) thereon.

The body unit 30 includes a tubular first wrench body 31, a tubular second wrench body 32, a fitting member 33, a battery pack 35, and a sleeve shell 34. The first wrench body 31 extends along a lengthwise axis and includes a front tubular end 311 fittingly engaged and secured with the joint segment 22 by means of screws 312, and a rear tubular end 313 opposite to the front tubular end 311. The second wrench body 32 is disposed rearwardly of and is aligned with the rear tubular end 313 along the lengthwise axis, and includes front and rear tubular portions 321, 323 opposite to each other. The fitting member 33 is in the form of a plug which has a fixed end 331 which is fitted in and secured with the rear tubular end 313 by means of screws 314, and a plug end 332 which has an outer diameter slightly smaller than that of the fixed end 331 and which is fitted in and rotatable relative to the front tubular portion 321 about the lengthwise axis so as to permit the first wrench body 31 to transmit a torque applied on the rear tubular portion 323 to the head unit 20. Preferably, the first and second wrench bodies 31, 32 are configured to be of substantially the same dimension in their outer diameters. Moreover, the plug end 332 of the fitting member 33 has an annular key groove 333 extending about the lengthwise axis. The front tubular portion 321 has a key 322 extending radially and inwardly to be slidably engaged in the key groove 333 so as to guide the rotation of the second wrench body 32 relative to the plug end 332. Additionally, the plug end 332 further has a barrier 334 which is disposed at the annular key groove 333 and which circumferentially confronts the key 322 so as to limit the extents of clockwise and counterclockwise movements of the second wrench body 32 during the rotation thereof. Hence, in this embodiment, each of the clockwise and counterclockwise movements of the second wrench body 32 is almost ranged from 0 to 360 degrees.

The battery pack 35 is disposed in the rear tubular portion 323 of the second wrench body 32 for receiving batteries (not shown) to supply power.

The sleeve shell 34 includes a mounting shell 342 sleeved on the front tubular portion 321, and a handgrip 341 which securely grips the rear tubular portion 323 to be disposed rearwardly of the mounting shell 342. The handgrip 341 may be integrally formed with the mounting shell 342. The display unit 40 is disposed on the mounting shell 342 to provide a display representing a torque measured by the strain gauge. Hence, the user can grip and rotate the handgrip 341 to rotate the display unit 40 and the second wrench body 32.

Figure 5:
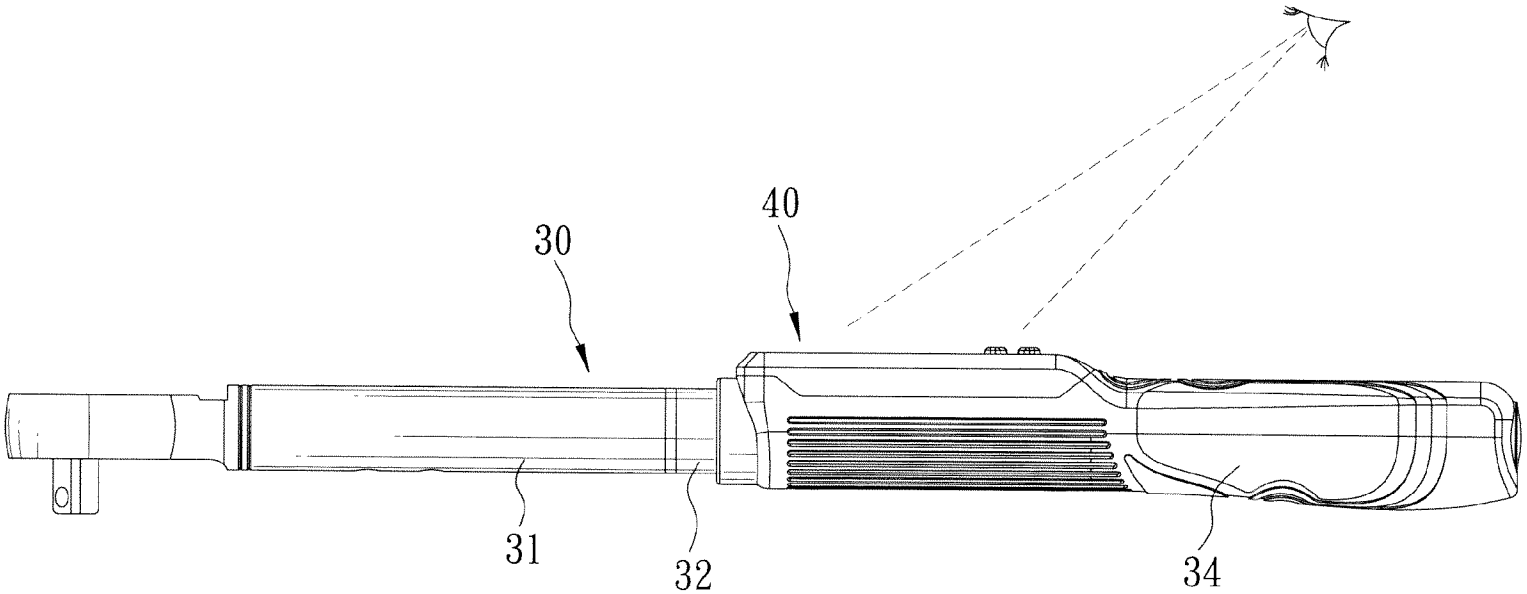
FIG. 5 is a schematic side view showing the first preferred embodiment during operation.
Figure 6:
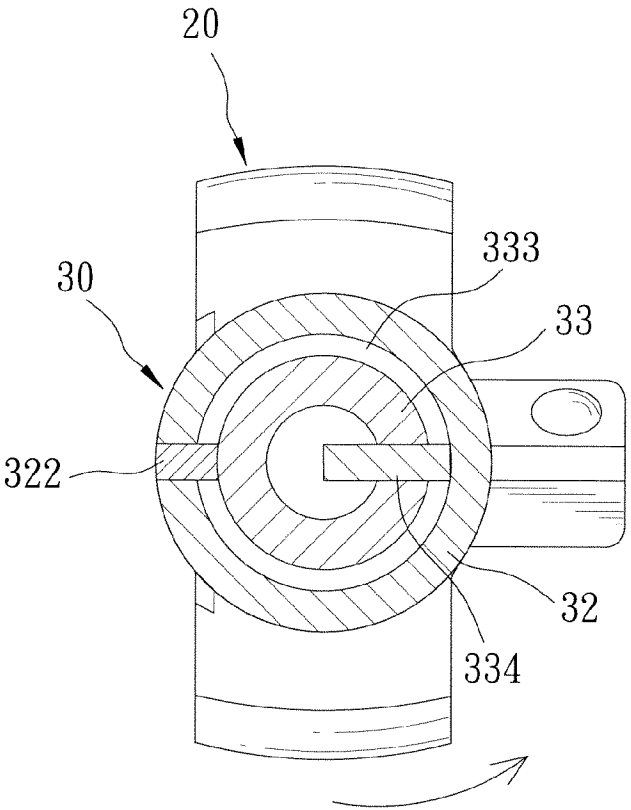
FIG. 6 is a cross-sectional view similar to FIG. 4, showing a second wrench body rotated to another angular position relative to a first wrench body.
Figure 7:
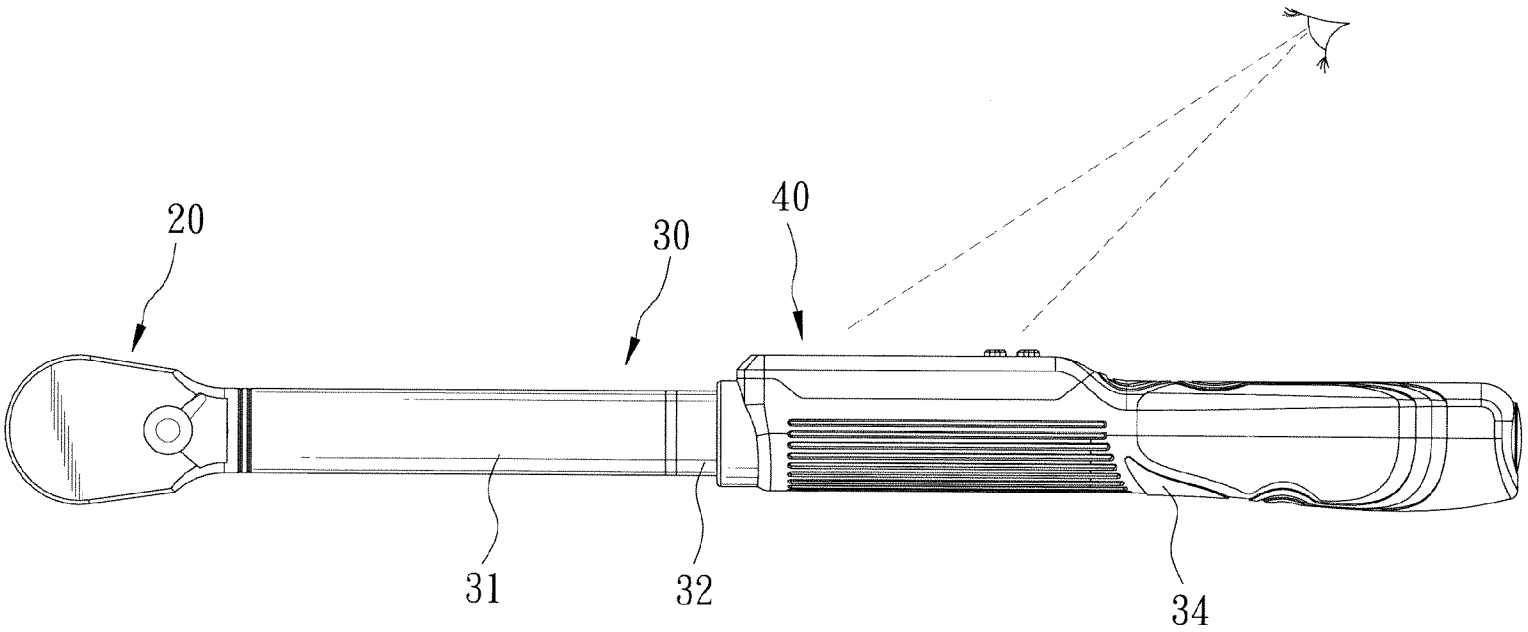
FIG. 7 is a schematic side view showing the first preferred embodiment in the state where the second wrench body is in another angular position.

Referring to FIG. 5, the user grips the handgrip 341 to apply a torque thereon, and can observe the display unit 40 to read numerical data of the measured torque. Referring to FIGS. 6 and 7, when the electronic torque wrench is turned to a different angular position as shown, the user can rotate the handgrip 341 about the lengthwise axis to rotate the display unit 40 as well as the second wrench body 32 so as to allow the display unit 40 to be uninterruptedly viewed by the user. On the other hand, the user can adjust the angular position of the second wrench body 32 and the sleeve shell 34 to keep the display unit 40 at his/her visible sight without varying the posture, thereby rendering operation of the electronic torque wrench convenient.

Figure 8:
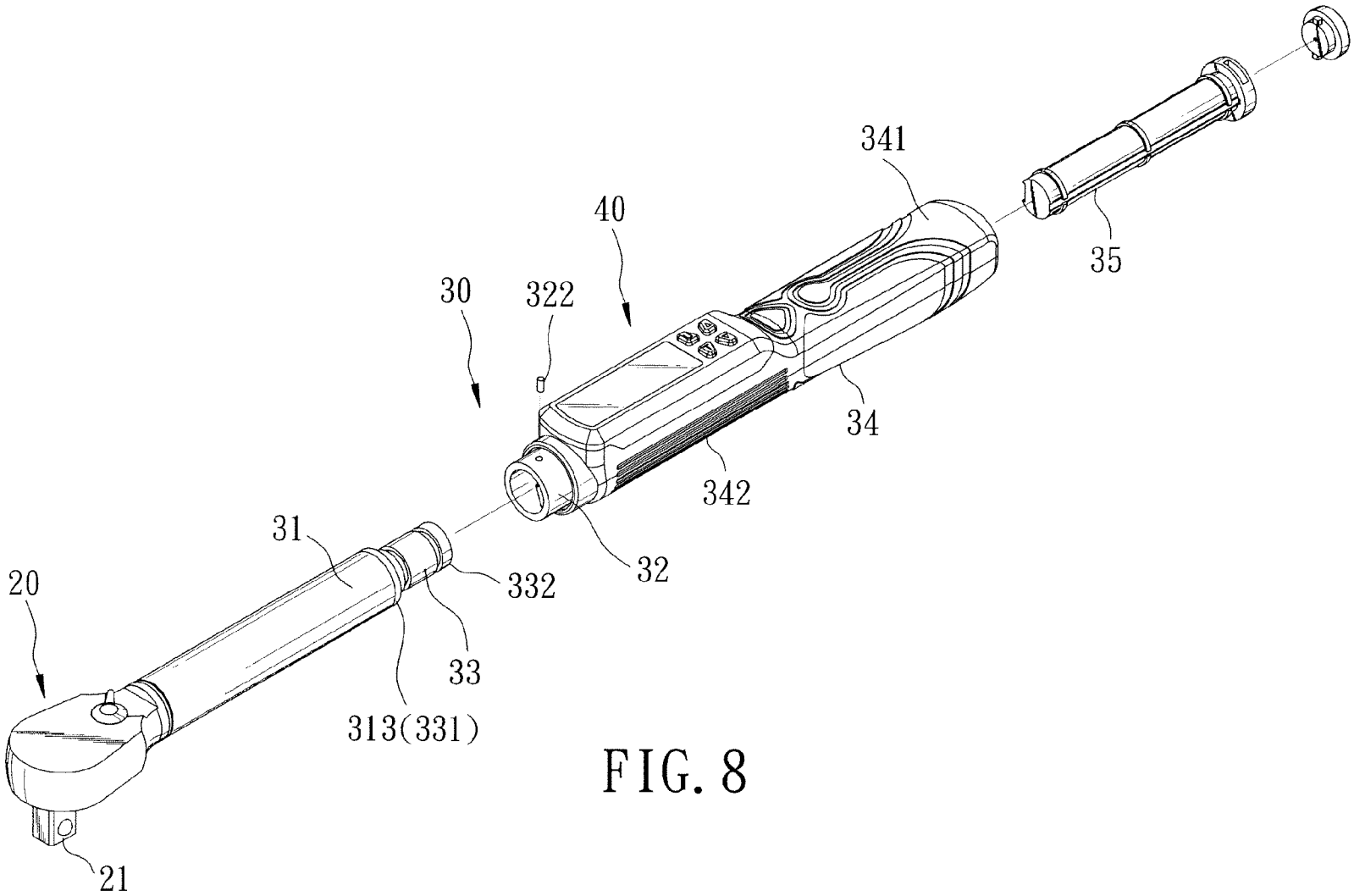
FIG. 8 is an exploded perspective view of the second preferred embodiment of an electronic torque wrench according to this invention.

FIG. 8 shows a second preferred embodiment of the electronic torque wrench according to this invention, which differs from the previous embodiment in that the fixed end 331 of the fitting member 33 is integrally formed with the rear tubular end 313 of the first wrench body 31.

Figure 9:
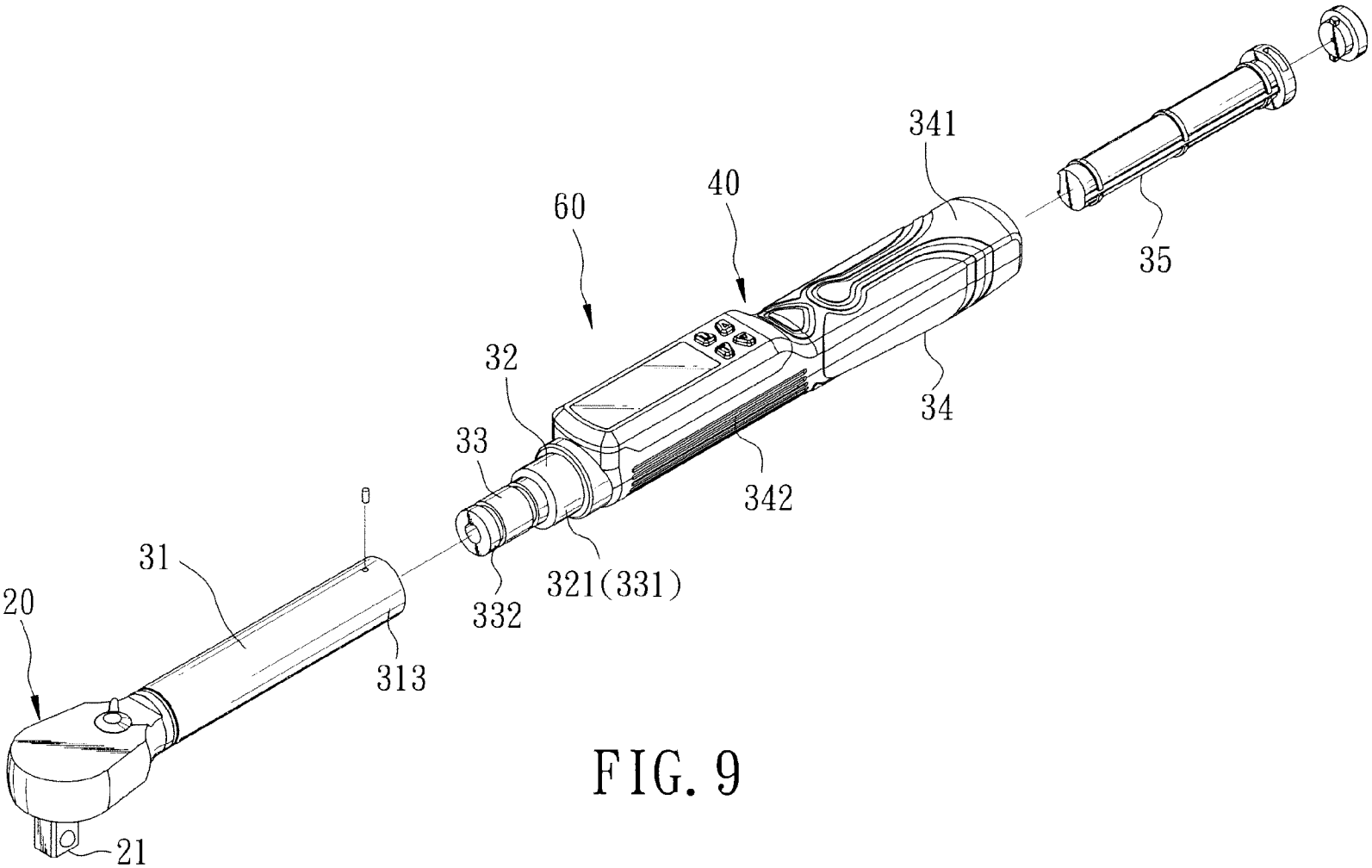
FIG. 9 is an exploded perspective view of the third preferred embodiment of an electronic torque wrench according to this invention.

Alternatively, referring to FIG. 9, in a third preferred embodiment, the fixed end 331 of the fitting member 33 is integrally formed with the front tubular portion 321 of the second wrench body 32 while the plug end 332 is rotatably fitted in the rear tubular end 313 of the first wrench body 31.

While the present invention has been described in connection with what is considered the most practical and preferred embodiment, it is understood that this invention is not limited to the disclosed embodiment but is intended to cover various arrangements included within the spirit and scope of the broadest interpretations and equivalent arrangements.

What is claimed is:

1. An electronic torque wrench comprising:

a wrench head adapted to engage and turn a fastener about a torque axis;

a joint segment extending radially from said wrench head relative to the torque axis for mounting a strain gauge thereon;

a tubular first wrench body which extends along a lengthwise axis and which includes a front tubular end fittingly engaged and secured with said joint segment, and a rear tubular end opposite to said front tubular end;

a tubular second wrench body which is disposed rearwardly of and which is aligned with said rear tubular end along the lengthwise axis, and which includes front and rear tubular portions opposite to each other;

a fitting member disposed to couple said rear tubular end of said first wrench body with said front tubular portion of said second wrench body to permit rotation of said second wrench body relative to said rear tubular end about the lengthwise axis, and to permit said first wrench body to transmit a torque applied on said rear tubular portion to said wrench head;

a mounting shell which is sleeved on said front tubular portion; and a display unit disposed on said mounting shell to provide a display representing a torque measured by the strain gauge.

2. The electronic torque wrench according to claim 1, wherein said fitting member is configured to have a plug end which is rotatably fitted into a respective one of said rear tubular end of said first wrench body and said front tubular portion of said second wrench body.

3. The electronic torque wrench according to claim 2, wherein said plug end of said fitting member has an annular key groove extending about the lengthwise axis, said respective one of said rear tubular end and said front tubular portion having a key which extends radially to be slidably engaged in said key groove so as to guide rotation of said second wrench body relative to said rear tubular end.

4. The electronic torque wrench according to claim 3, wherein said plug end of said fitting member further has a barrier which is disposed at said annular key groove and which circumferentially confronts said key so as to limit the extents of clockwise and counterclockwise movements of said second wrench body.

5. The electronic torque wrench according to claim 2, wherein said first and second wrench bodies are configured to be of substantially the same dimension in their outer diameters.

6. The electronic torque wrench according to claim 5, further comprising a handgrip which securely grips said rear tubular portion and which is disposed rearwardly of said mounting shell.

7. The electronic torque wrench according to claim 6, wherein said handgrip is integrally formed with said mounting shell.

8. The electronic torque wrench according to claim 2, wherein said fitting member has a fixed end opposite to said plug end and integrally formed with said rear tubular end.

9. The electronic torque wrench according to claim 2, wherein said fitting member has a fixed end opposite to said plug end and integrally formed with said front tubular portion.

* * * * *